US006684617B2

(12) United States Patent
Longaygue et al.

(10) Patent No.: US 6,684,617 B2
(45) Date of Patent: Feb. 3, 2004

(54) PROCESS ALLOWING TO INCREASE THE CRACKING CORROSION RESISTANCE OF A WIRE UNDER STRESS

(75) Inventors: Xavier Longaygue, Noisy le Roi (FR); Christian Boudou, Villepreux (FR)

(73) Assignee: Institut Francais du Petrole, Rueil-Malmaison cedex (FR)

( * ) Notice: Subject to any disclaimer, the term of this patent is extended or adjusted under 35 U.S.C. 154(b) by 117 days.

(21) Appl. No.: 09/988,414

(22) Filed: Nov. 19, 2001

(65) Prior Publication Data

US 2002/0108364 A1 Aug. 15, 2002

(30) Foreign Application Priority Data

Dec. 7, 2000 (FR) ..... 00 15915

(51) Int. Cl.[7] ..... D02J 3/04
(52) U.S. Cl. ..... 57/6; 57/309
(58) Field of Search ..... 57/3, 6, 309, 351; 493/287

(56) References Cited

U.S. PATENT DOCUMENTS 3,234,721 A 2/1966 Carter
3,309,862 A * 3/1967 Hood ..... 57/2
3,800,522 A * 4/1974 Hughes et al. ..... 57/215

FOREIGN PATENT DOCUMENTS

| | | | |
|---|---|---|---|
| FR | 83 05658 | 4/1983 | ..... C21D/7/02 |
| JP | 57-210916 | 12/1982 | ..... C21D/8/00 |

OTHER PUBLICATIONS

Patent Abstracts of Japan 57210916 Dec. 24, 1982.

French Search Report with English language translation.

* cited by examiner

*Primary Examiner*—John J. Calvert
*Assistant Examiner*—Shaun R Hurley
(74) *Attorney, Agent, or Firm*—Antonelli, Terry, Stout & Kraus, LLP

(57) ABSTRACT

In order to increase the cracking corrosion resistance of a wire under stress compressive stresses are introduced through surface treatment by brushing, on the apparent surface of the wire. A system and method are notably applied for the manufacture of wire-reinforced flexible pipes. The reinforcing wires are subjected to a surface treatment by brushing after setting the wires on the flexible pipe.

2 Claims, 2 Drawing Sheets

PROCESS ALLOWING TO INCREASE THE CRACKING CORROSION RESISTANCE OF A WIRE UNDER STRESS

FIELD OF THE INVENTION

The present invention relates to a method and to a system allowing to increase the cracking corrosion resistance of a wire under stress used for manufacturing armoured flexible pipes intended for petroleum reservoirs development.

It is well-known that certain metals are sensitive to cracking corrosion when they are exposed to certain aqueous corrosive environments, notably aqueous environments containing hydrogen sulfide, and simultaneously subjected to tensile stresses, their sensitivity to cracking corrosion being all the higher as the plastic deformation under tensile stress is high. Stress cracking in a corrosive environment generally develops from the surface.

Stress cracking resistance in an environment containing hydrogen sulfide (SSC: Sulfide Stress Cracking) is a determining property for steels intended for flexible oil pipes reinforcement. In fact, it conditions the nature of the steels that can be used, both in terms of composition and of state of treatment.

BACKGROUND OF THE INVENTION

The use of low-alloy tempered and hardened steel wires is now conventional for the tension layers of flexible pipes manufactured in the industry. This metallurgy is the best compromise between mechanical strength and SSC resistance.

Documents FR-1,426,113, GB-1,054,979 and DE-1,227,491 notably describe processes for improving the resistance of materials to corrosion, wherein these metals are subjected to cold mechanical surface treatments. The improvement is explained by the fact that the surface is placed under compression, which is opposed to the external tensile stresses and thus reduces the risk of incipient cracking.

However, compression due to the surface treatments proposed in the prior art is accompanied by substantial strain hardening of the surface. This strain hardening reflects a high dislocation density, which makes the metal more sensitive to stress cracking in a corrosive environment. Furthermore, strain hardening through surface treatment according to the prior art damages the surface. In fact, the roughness of the surface treated increases considerably.

Patent FR-2,543,976 proposes a method for placing wires under superficial compression by means of a succession of flexions. However, during manufacture of the flexible pipes, the wires are deformed during the armouring operation which consists in winding said wires around the core consisting of the underlying layers. The most critical part of the wire is the part that has undergone the greatest permanent tensile strain and which is therefore situated on the external face of the flexible pipe. The elongation ratios generated can reach or even exceed 5%, considering the typical dimensions of the flexible pipes and of the wires. Work on this subject has shown that this deformation level could lead to a considerable fall in the SSC resistance: the non-breaking threshold stress becomes markedly lower than the required level, i.e. 90% of the yield strength $Rp_{0.2}$.

SUMMARY OF THE INVENTION

The main object of the invention is to improve, in relation to the prior art, the SSC protection of flexible pipe reinforcements subjected to tensile stresses. The invention therefore proposes brushing the surface of a reinforcing wire after setting it on a flexible pipe.

The invention is basically defined as a method of manufacturing a flexible pipe reinforced with wires, wherein the outer surface of said wires is subjected to a surface treatment by brushing after setting said wires on said flexible pipe.

The invention also relates to a system for manufacturing a flexible pipe reinforced with wires, wherein means intended for surface treatment by brushing of the outer surface of said wires are arranged downstream from the zone where said wires are set in relation to the direction of feed of the flexible pipe.

The stress level that can be obtained depends on the brushing conditions and on the intrinsic characteristics of the material. This compression is due to the plasticization of the surface layers of the metal. However, the nature of the strain hardening is different from that conventionally obtained by sandblasting, machining or shot blasting. In fact, the surface of the brushed parts is less "brutalized" than with the processes proposed in the prior art, which leads to a low strain hardening degree, to a low mobile dislocation density and to a limited roughness of the surface treated. Brushing thus is an efficient means for limiting fatigue problems and for reducing risks of stress-corrosion cranking.

Furthermore, many parameters (wire exit, brush diameter, rotating speed, bristle diameter, . . .) are available to the user and allow him to obtain, according to the desired use: either a greatly compressed surface but not very altered in depth, or a more penetrating compression associated with lesser deformations and stress levels at the surface.

Treatment of the surface of the wire is advantageously carried out after it has been set on the flexible pipe. Thus, the surface treatment is not altered by the stresses and the strain hardening induced upon setting of the wire on the flexible pipe.

BRIEF DESCRIPTION OF THE FIGURES

Other features and advantages of the present invention will be clear from reading the description hereafter, with reference to the accompanying drawings wherein.

DETAILED DESCRIPTION

Figure 1:
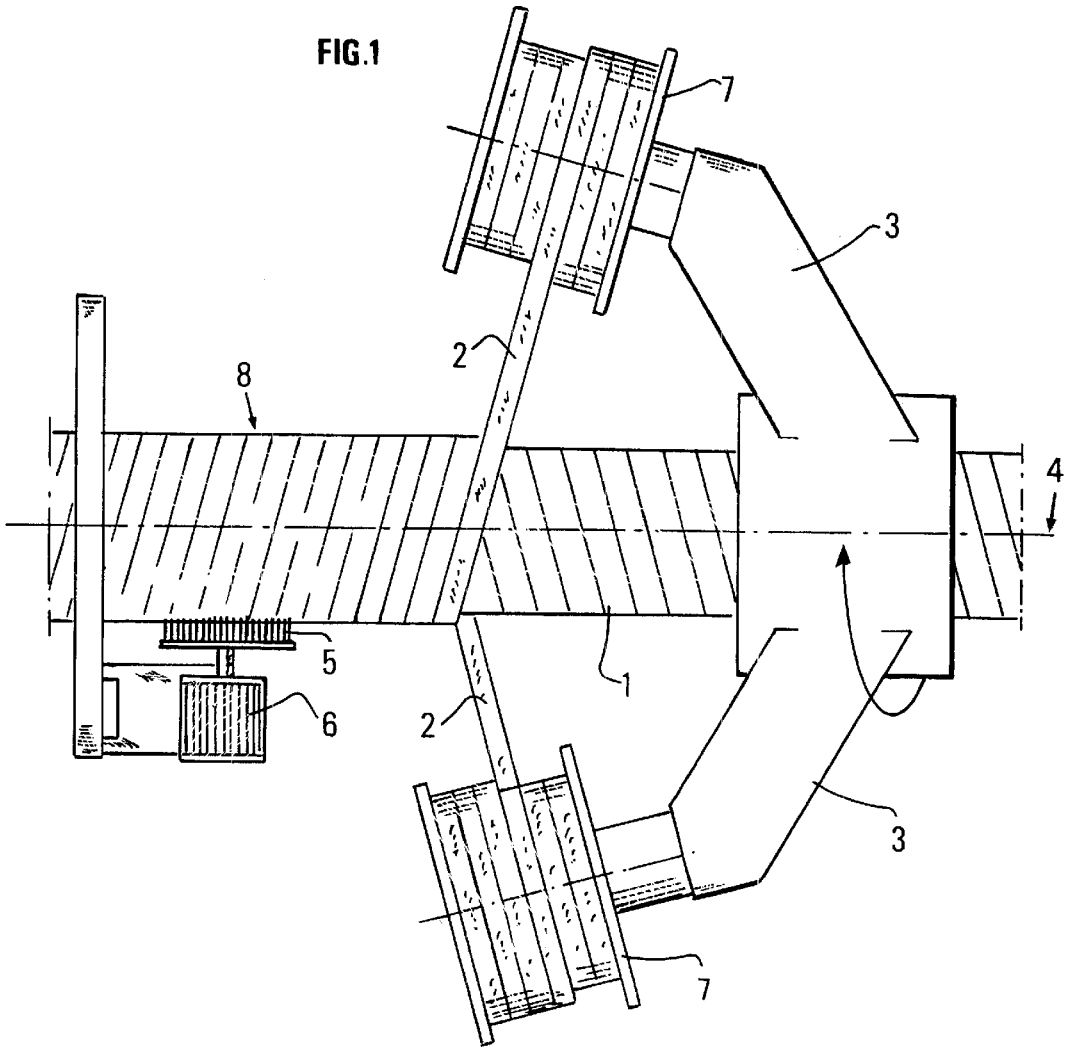
FIG. 1 diagrammatically shows an implementation of the invention.

Brushing of the surfaces is carried out mechanically by means of brushes. FIG. 1 shows an equipment allowing the invention to be implemented. A flexible pipe core 1 consists of one or more polymer sheaths on which wire layers have already been wound. The wires wound at an angle close to 90° in relation to axis 4 form an armour, commonly referred to as pressure layer, taking part in the internal and/or external pressure resistance of the flexible pipe. The wires wound at an angle of about 45° in relation to axis 4 form an armour taking part in the tensile strength of the flexible pipe. The surface treatment by brushing according to the invention can be applied indiscriminately to all the metallic armours of the flexible pipe.

The flexible pipe core is translated forward in relation to axis 4. One or more wire reels 7 mounted on a mobile conveyor 3 rotating in relation to axis 4 allow continuous delivery of wire 2. Thus, the core of a helically wound wire layer 8 is armoured by combining the rotating motion of conveyor 3 and the translation motion of core 1. During this operation, wire 2 undergoes a plastic deformation, and the face of the armouring situated outside the flexible pipe core undergoes a permanent tensile strain that can exceed 5% considering the typical dimensions of the flexible pipes and of the reinforcing wires.

After being wound around the flexible pipe core, the wire is subjected to the brushing operation. A brush 5 actuated in rotation by a motor 6 brushes wire layer 8 that is already wound on the flexible pipe core. The translation and rotation mobilities, in relation to axis 4, of the assembly consisting of brush 5 and of motor 6 allow the whole external face of the wire layer apparent on the outside of the flexible pipe core to be treated.

FIG. 1 shows a brush whose bristles are parallel to the axis of rotation of the brush. However, without departing from the scope of the invention, it is also possible to use a brush whose bristles are substantially perpendicular to the axis of rotation of the brush.

In order to adjust the brushing operation to a given configuration and to a determined stress level, parameters such as the rotating speed of the brush, the number of passes, the pressure exerted, the direction of brushing or the lubrication can be varied. Parameters directly linked with the geometry of the brush, such as the material of the bristles, the length of the bristles, the diameter of the bristles and the outside diameter of the brush are also used to modulate the brushing operation.

Comparisons have been made between a surface treatment with a weak strain hardening according to the invention (brushing) and a surface treatment with a great strain hardening (shot blasting).

The material studied is a 32C1 low-alloy steel, in the tempered and hardened state, in form of flat wires of rectangular section 12×4 $mm^2$ obtained by round wire rolling. In order to remain close to industrial conditions, we have subjected the material to the following thermal treatment: austenitization consisting in heating to 950° C. for ½ hour, followed by salt water hardening (10% NaCl), then 2-hour tempering at 585° C. The mechanical tensile characteristics of the samples are given in Table 1.

TABLE 1

Mechanical characteristics after retreatment

| $Rp_{0.2}$ (MPa) | Rm (MPa) | Ar (%) |
|---|---|---|
| 682 ± 12 | 810 ± 5 | 20.4 ± 0.7 |

The samples have first been strain hardened in order to simulate plastic deformation during armouring of the wire on the flexible pipe blank. The samples underwent a 5% homogeneous elongation.

The samples have subsequently been subjected to a surface treatment. Half of the samples were subjected to shot blasting, and the second half to brushing.

Shot blasting was carried out with a rotary-plate shot blasting machine, with 400 μm diameter steel balls. The Almen deflection was F30A, with a 125% covering for all the samples.

Figure 2:
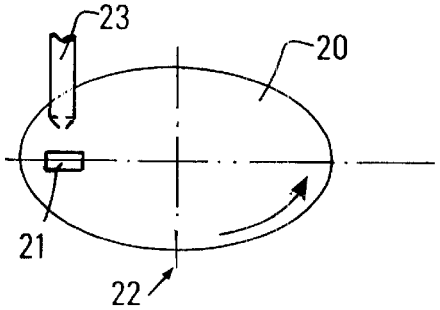
FIG.2 PRIOR ART
FIG. 2 diagrammatically shows the shot blasting device according to the prior art, FIG. 3 diagrammatically shows the principle of the brushing device according to the invention.

The testing principle is diagrammatically shown in FIG. 2. Sample 21 is held in position on plate 20. A fixed nozzle 23 ejects balls onto plate 20 rotating about axis 22. The shot blasting parameters are given in Table 2.

TABLE 2

Shot blasting parameters

| | |
|---|---|
| Pressure | 3 bars |
| Discharge rate | 3 kg/min |
| Plate rotating speed | 14.5 rpm |
| Nozzle-sample distance | 340 mm |
| Distance/axis of rotation of plate | 300 mm |
| Number of revolutions of plate | 20 revolutions |
| Ball type | BA400 steel balls D = 400 μm |
| Almen deflection | F30A |
| Covering | 125% |

The entirely shot blasted surface, i.e. with a 100% covering, is obtained after 16 revolutions of the plate rotating at 14.5 rpm, the sample being 340 mm away from the nozzle. Thus, 20 revolutions produce a 125% covering.

Figure 3:
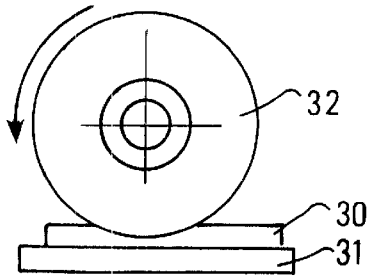

The brushing operation shown in FIG. 3 is carried out by means of a brush 32 mounted on a horizontal-axis milling machine. The bristles of the brush are arranged substantially perpendicular and radially in relation to the axis of rotation. During the operation, sample 30 was fastened to a magnetic plate 31. The adjustments summed up in Table 3 were selected to optimize the brushing parameters.

TABLE 3

Brushing parameters

| Brush type | HR steel |
|---|---|
| Outside diameter of the brush | 300 mm |
| Bristle length | 100 mm |
| Bristle diameter | 0.1 mm |
| Rotating speed of the brush | 1600 rpm |
| Forward motion rate | 500 mm/min |
| Pressure of the brush on the sample | 4% of the length of the bristle, i.e. 4 mm |

The roughness of the samples was measured in the initial state, after brushing and after shot blasting. The roughness measurement results are given in Table 4. They show that this property is only slightly degraded by brushing, but that shot blasting causes much more damage.

TABLE 4

Roughness values after the various surface treatments

| State | Rz (μm) | Rmax (μm) | Ra (μm) |
|---|---|---|---|
| Initial state | 0.76 | 1.25 | 0.07 |
| Brushed | 0.77 | 1.08 | 0.11 |
| Shot blasted | 35.07 | 43.30 | 6.51 |

Figure 4:
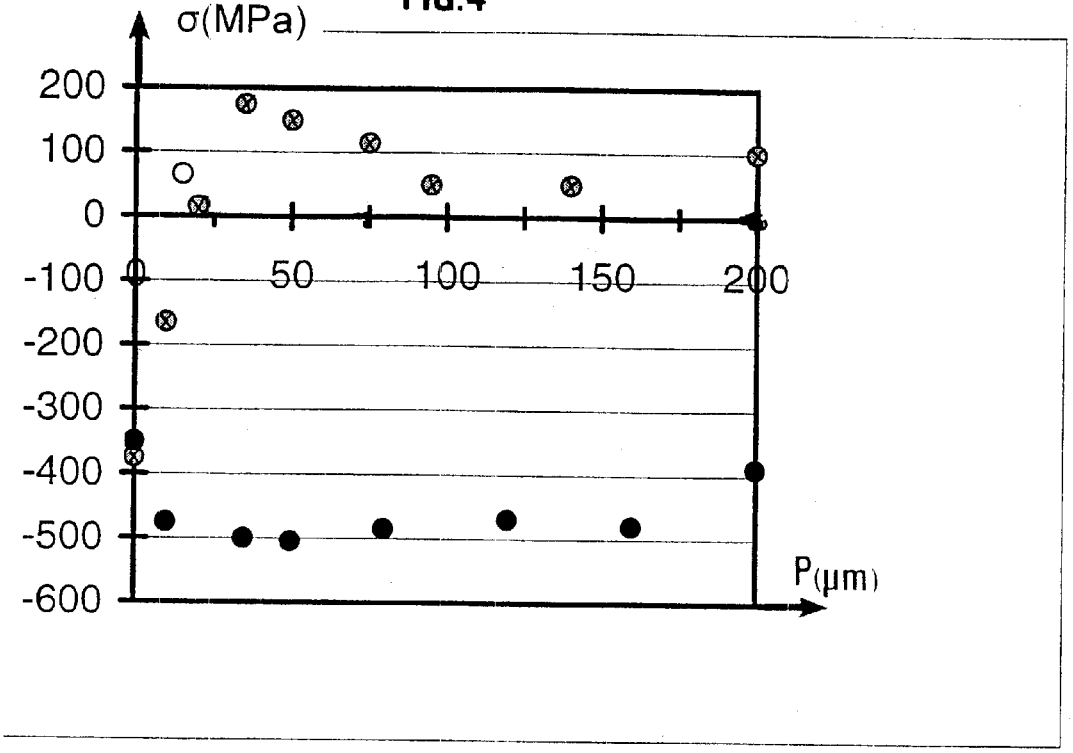
FIG. 4 shows the stress measurements as a function of the depth at the surface of a sample.
Figure 5:
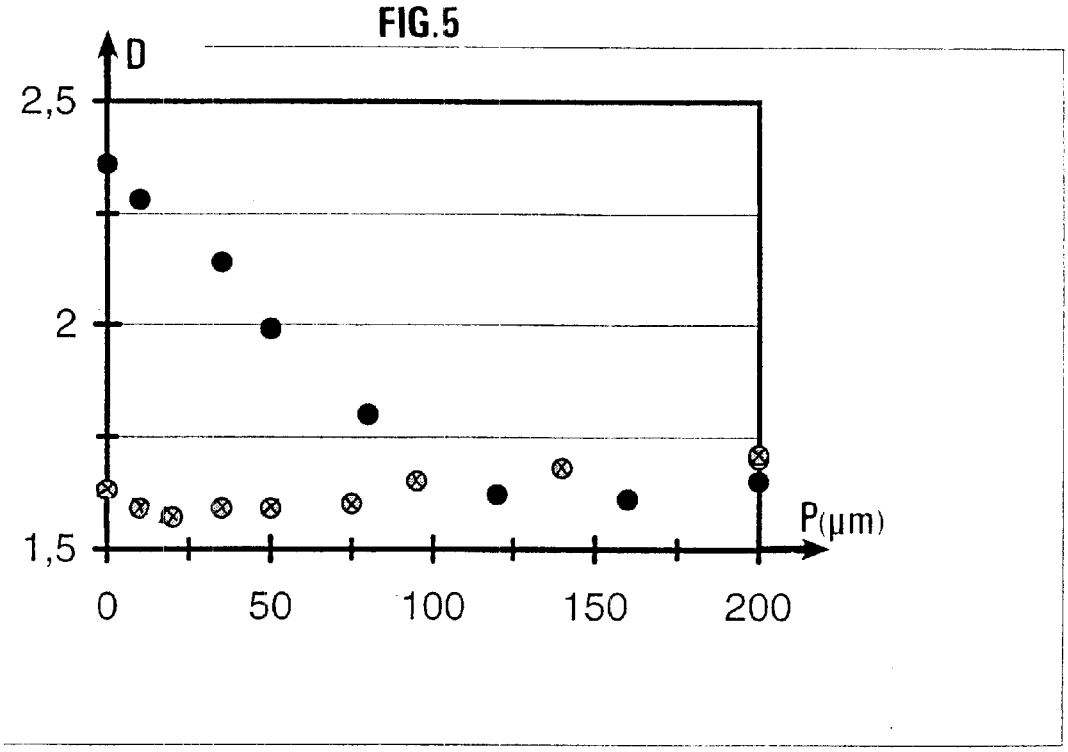
FIG. 5 shows the strain hardening degree measurements as a function of the depth at the surface of a sample.

After the surface treatments, the mean stress level and the mean strain hardening degree at the surface of the samples were established by X-ray diffraction measurements. The mean level of the strain hardening degree corresponds to a qualitative measurement and it therefore only allows to compare values obtained with the same measuring method. The graphs of FIGS. 4 and 5 show, on the ordinate axis, respectively the mean stress level σ in MPa and the mean level of the strain hardening degree D as a function of depth P in μm shown on the abscissa axis. In FIGS. 4 and 5, the crosses surrounded with circles represent the measurements obtained on a brushed sample, the black circles represent the measurements obtained on a shot blasted sample.

In FIG. 4 showing the mean stress level σ (in MPa) as a function of depth P (in μm), it can be seen that brushing induces high compressive stresses (−350 MPa) at the surface of the samples, which however rapidly decrease deeper inside. The affected depth is about 50 μm. On the other hand, shot blasting induces a much more efficient stress profile as regards compression. The high compression level at the surface becomes more marked deeper inside, and it decreases only very slightly afterwards.

FIG. 5, which shows the mean level of strain hardening degree D as a function of depth P (in μm), shows that the shot blasted samples have undergone a much greater local strain hardening than the brushed samples. The shot blasted state induces a higher disturbance level, and over a greater depth.

The measurement results of the mean stress level and of the mean level of the strain hardening degree at the surface of the samples allow to characterize shot blasting and brushing as regards SSC resistance. Compression is lower and over a more limited depth in the case of brushing, on the other hand the strain hardening degree is lower with brushing, which is favourable for increasing the SSC resistance.

Additional series of tests have been carried out on the shot blasted and brushed samples in order to determine which phenomenon (the strain hardening degree or compression) is the more determining factor for SSC resistance.

The SSC tests were carried out according to the NACE TM0177-99 recommendation (method A)<Laboratory testing of metals for resistance to specific forms of environmental cracking in $H_2S$ environments >>. This methodology consists in exposing the sample to the embrittling $H_2S$ environment while maintaining it under a static mechanical load, in uniaxial tension (by means of a dynamometric ring) in the elastic domain.

The test environment consists of a saline solution (distilled water +5% by weight NaCl) containing 0.5% acetic acid. This solution is prepared in a reactor where it is deaerated by circulation of an inert gas prior to being transferred into the cell containing the sample. It is then brought to a pH value of 2.7 by $H_2S$ saturation: continuous bubbling is maintained throughout the test (30 days).

The SSC resistance is quantified by the non-breaking threshold stress which is the highest stress for which the sample has outlived the test. The results of these tests are summed up in Table 5.

TABLE 5

SSC test results

| Plastic strain (%) | Yield strength Rp (MPa) | SSC threshold stress (MPa) | SSC threshold stress (% Rp) |
|---|---|---|---|
| 5 + brushing | 800 | ≧720 | ≧90 |
| 5 + shot blasting | 800 | <720 | <90 |

Despite the prior 5% plastic strain, the brushed samples have undergone no break, even with the highest load, which was nevertheless above the initial yield strength of the steel. This good performance can be explained by the combination of the compressive stresses induced and of the moderate strain hardening degree at the surface.

On the other hand, the shot blasted samples have undergone a break in the middle of the useful zone of the sample, accompanied by a marked striction.

The second tests consist in measuring the rate of uniform corrosion of the samples. The uniform corrosion test was carried out in the same environment (and with an identical method of preparation) as the SSC tests.

The samples were divided into two batches so as to be exposed to the corrosive environment for 10 and 30 days respectively. These two batches were placed in distinct reactors where degassing of the solution (distilled water +5% by weight of NaCl) and $H_2S$ saturation thereof in order to obtain a pH value of 2.7 were also carried out.

The short-time and long-time uniform corrosion was determined by loss of mass, the samples being weighed before and after the test, with a $10^{-4}$ gram precision. The thinning rate (μm/year) was calculated by means of the formula described in the ASTM G-90 standard, which takes into account the exposed surface area and the density of the material (7.8 g/cm$^3$ for steel). Table 6 gives the corrosion rate measurements in a $H_2S$ environment.

TABLE 6

Synthesis of the uniform corrosion rates in a saturated $H_2S$ environment

| Corrosion rate (μm/year) | Brushed state | Shot blasted state |
|---|---|---|
| 10 days | 504 | 739 |
| 30 days | 622 | 778 |

The shot blasted samples have a higher corrosion rate, which can be explained by a greater roughness (contact surface increase) and maybe also by a higher chemical reactivity of their surface, in connection with the higher strain hardening degree.

In conclusion of the various tests described above, the brushing process according to the invention leads to a remarkable result. The samples tested as regards SSC resistance have undergone no break thanks to compression at the surface, to the low strain hardening degree and to the maintenance of a limited roughness. Furthermore, implementation of the brushing process on a flexible pipe production line is easy and requires no changes in the sequences of operations. The brushing device is arranged between the forming machine downstream from the wire setting point and the external polymer sheath extruder.

What is claimed is:

1. A method for manufacturing a wire-reinforced flexible pipe, comprising helically winding metallic wires around a flexible pipe, and strain hardening the outer surface of said wires by subjecting the outer surface of said wires to a surface treatment by brushing after winding said wires on said flexible pipe.

2. A system for manufacturing a wire-reinforced flexible pipe, comprising means for helically winding metallic wires around a flexible pipe, and means for strain hardening the outer surface of said wires by brushing the outer surface of said wires downstream from the means for helically winding in relation to the direction of feed of the flexible pipe.

* * * * *